US007001229B2

(12) United States Patent
Kettelson

(10) Patent No.: US 7,001,229 B2
(45) Date of Patent: Feb. 21, 2006

(54) WATER VEHICLE PROPELLER

(76) Inventor: Ernest Kettelson, 16801 Ridge Rd., Minooka, IL (US) 60447

( * ) Notice: Subject to any disclaimer, the term of this patent is extended or adjusted under 35 U.S.C. 154(b) by 0 days.

(21) Appl. No.: 10/679,851

(22) Filed: Oct. 6, 2003

(65) Prior Publication Data

US 2005/0075015 A1 Apr. 7, 2005

(51) Int. Cl.
*B63H 1/26* (2006.01)

(52) U.S. Cl. ..... 440/48

(58) Field of Classification Search ..... 440/48
See application file for complete search history.

(56) References Cited

U.S. PATENT DOCUMENTS

| | | | | | |
|---|---|---|---|---|---|
| 1,041,232 | A * | 10/1912 | Berry | 440/48 |
| 2,285,023 | A * | 6/1942 | Fergus | 440/48 |
| 2,379,235 | A * | 6/1945 | Hughes | 440/48 |
| 3,070,061 | A * | 12/1962 | Rightmyer | 440/48 |
| 3,441,088 | A * | 4/1969 | Levy | 415/74 |
| 4,734,067 | A * | 3/1988 | Elias-Reyes | 440/48 |
| 6,431,926 | B1 * | 8/2002 | Rosefsky | 440/48 |

* cited by examiner

*Primary Examiner*—Jesus D. Sotelo
(74) *Attorney, Agent, or Firm*—Ernest Kettelson

(57) ABSTRACT

In this specification regarding water vehicle propellers, the gist of the technical disclosure resides in the construction of a propeller having elongated blades which extend in a helical path and longitudinally of the hull of a water vehicle in an unbroken length, singly or in aligned sections following the contour of the hull, for substantially its entire length or that portion of the length of a water vehicle in contact with the body of water when under way. The elongated propellers are rotated on their longitudinal axis. In addition, two of such elongated propellers or aligned sections of such propellers are mounted parallel for rotation in opposite directions either within a tubular housing open at the front and rear or mounted directly adjacent the hull with one or more on either side. Spaced apart longitudinal support members are secured below the elongated propellers to prevent contact with an object or objects from below and to support the propellers and hull above any such objects. One of such propellers may be mounted below a forward portion of a vessel and a second below a rearward portion, each propeller being pivotable outwardly in opposite directions from the longitudinal axis of the vessel to enable the vessel to turn more rapidly from one direction to another.

23 Claims, 14 Drawing Sheets

WATER VEHICLE PROPELLER

FIELD OF THE INVENTION

This invention relates to a new and useful propeller and propulsion system for water vehicles.

BACKGROUND OF THE INVENTION

The most common means now employed to move power boats through the water is the longitudinally short screw propeller. The theory of the action of the screw propeller has been the subject of consideration by many investigators. One theory is that the propeller impresses change of motion upon the water without change of pressure except such as is caused by the rotation of the screw. Another theory is that the thrust is obtained by change of pressure, the only changes of motion being the circumferential velocity due to the rotation of the propeller. Still others are referred to as the momentum theory and the vortex theory. The confused nature of the water at the stern of a moving boat makes the application of theory to marine screw propeller operation extremely complicated and not definitively known. In any event, there is considerable slippage with the conventional screw propellers as between the distance advanced in the water compared to the linear feet of water actually passed through the propeller blades. Ideally the distance advanced should equal the number of linear feet of water passing through the blades from front to rear. The propeller in accordance with the present invention approaches that ideal.

The severe limitations of present and prior art screw type propellers mounted at the stern of the boat can be understood more clearly by observing the much greater propulsion force of large sea creatures such as dolphins and whales. Though weighing as much as many manufactured water vehicles, they generate enough propulsion force by movement of their tail fins, dorsal fins and other parts of their body to lift their substantial weight out of and above the surface of the water. No manufactured water vehicle having a conventional prior art propeller system is able to generate the propulsion force needed to accomplish that. By watching dolphins, whales and other huge water creatures and the much greater propulsion force they are able to generate by movement of their fins and other parts of their bodies, which is largely a semi-twisting and back-and-forth movement the thought arises as to how much greater propulsion force those sea creatures would be able to generate if they could rotate or spin their fins in a continuous ever increasing rotations per minute. If a quick half turn, or quarter turn of their elongated tail fin can generate enough propulsion force to lift those heavy sea creatures out of and above the water, think of how much greater propulsion force if those elongated tail fins could be continually rotated in continually increasing rotations per minute. Living sea creatures such as dolphins and whales cannot do that, but manufactured propeller systems having comparable elongated fins can be designed to simulate the natural motion of those large sea creatures and which can be continuously rotated in continually increasing rotations per minute. That concept is incorporated in the elongated spinning fin propellers in accordance with this invention, and in manufactured water vehicles having such spinning fin propellers installed thereon, resulting in greatly increased propulsion force of such propellers and such water vehicles through the water as well as increased velocity.

Another disadvantage of conventional screw propeller water craft is that large portions of the hull are in sliding-frictional contact with the water, requiring the propellers to push the hull head-on against the resistance of the water displaced with no means throughout such hull surface to assist in moving the craft forward. Ideally, all parts of a vehicle in frictional contact with a medium on which or in which it moves should either itself impart motion or else be converted from sliding friction to rotating or moving friction wherever possible. An automobile for example is in frictional contact with the ground at the four points where its wheels touch, the contacts being rotating or rolling friction and with two or more of the wheels under power to impart motion. If the two front wheels were held in fixed position or if the entire body of the car were in sliding frictional contact with the ground, and only the two rear wheels were imparting motion, this would be somewhat analogous in a land vehicle to the way conventional screw propeller boats are operated in the water medium. The frictional resistance of water is of course much less, but even here it would be of advantage to either convert sliding friction contact into rotating or moving friction or into actual motion imparting means. The propeller in accordance with the present invention accomplishes that objective in large part. Here again it is comparable to the movement of living water creatures who impart moving friction to the water throughout the entire portion of their bodies that is in contact with the water by their continuous back and forth movements. Rotational movement of a pair of elongated spinning fin propellers in accordance with this invention, mounted either adjacent to each other, or in longitudinal alignment, each rotated in opposite directions of rotation but with their elongated fins configured to propel them forward even though rotated in opposite directions of rotation, create comparable movement through the water for the entire length of the elongated propellers and of the hull of the boat adjacent to and above such elongated propellers.

The elongated propellers in accordance with this invention include one or more elongated blades which extend from the front end of the propeller to the rearward end in a slightly helical path that may be less than one full turn from the front end to the rearward end.

Conventional screw propeller water craft also encounter what is known as wave resistance, separate and apart from frictional resistance, thus incurring additional energy loss due to wave making. This particular resistance is not too considerable at low speeds but constitutes a greater portion of the total resistance at high speeds. It would be of advantage therefore to convert as much of the portion of a boat in contact with the water into means which would not make waves or which would reduce the size of the waves. The elongated propeller in accordance with the present invention accomplishes that objective. This is particularly true when two of such elongated spinning fin propellers, one with elongated blades extending in a right-hand-turn helical path and the other with elongated blades extending in the opposite left-hand-turn helical path, are mounted in side-by-side relationship and rotated in opposite directions of rotation which propels water downwardly between them as well as rearwardly, as disclosed in greater detail herein below and in the drawings. Such motion tends to not only propel a vessel forward, but to also lift it vertically in the water. When the elongated spinning fin propellers in accordance with this invention are mounted that way on a vessel, spaced apart longitudinal bars or skids may be secured to the vessel or propeller housing below the propellers along their entire length to rest on the bottom of the body of water in the event the vessel becomes grounded. The elongated propellers are thus held above the bottom of the body of water by such longitudinal bars and free to be rotated to exert lifting force by propelling water downwardly between the propellers as well as rearwardly, to thus free the vessel equipped with such propellers and spaced apart longitudinal bars or skids in accordance with this invention.

SUMMARY OF THE INVENTION

It is an object of this invention to overcome the disadvantages of prior art propellers and of prior art vessels equipped with prior art propellers, such as slippage, sliding frictional resistance and wave resistance to a much greater extent than in conventional screw propeller water craft. The invention provides a rotatable propeller having elongated helical blades which extend fore and aft for substantially the entire length of that portion of the boat or ship which is normally in surface contact with the body of water when under way. Each of the helical blades may have less than one full spiral turn throughout its length in a preferred embodiment which when rotated more nearly resembles the motion of the tail fin, dorsal fin and other body parts of living creatures of the sea. Each propeller may have three or more of such helical blades equally spaced apart arcuately around the axis and central shaft of the propeller. It is preferable to use two of these propellers mounted closely together in parallel relationship, one having elongated blades extending in a right-hand turn helical path and the other having elongated blades extending in the opposite left-hand-turn helical path, within a housing having an intake opening in the front, a discharge opening in the rear, and which may have an opening underneath extending longitudinally through the entire length of the housing, preferably with longitudinal bars or skids mounted below to keep the propellers from touching the bottom of the body of water in the event the vessel itself becomes grounded. The propellers when thus mounted are rotated in opposite directions, but with their elongated fins or helical blades configured to propel water rearwardly when so rotated in opposite directions of rotation. Two or more sets of such dual mounted propellers may be installed on a water craft. These and other objects of the invention, as well as the manner in which the invention overcomes the disadvantages of conventional screw propeller water craft, will be explained more fully in the following detailed description and the accompanying drawings.

It is an object of the invention to increase maneuverability of watercraft in the water, particularly very large vessels, by providing a first elongated spinning fin propeller assembly under the forward part of the vessel which can be separately rotated on a vertical axis toward the right to cause that part of the vessel to move toward the right, and a second elongated spinning fin propeller assembly under the rearward part of the vessel which can be separately rotated on a vertical axis toward the left to cause that part of the vessel to move toward the left, thereby causing the vessel to make a more rapid ninety degree turn to the right, or left if the first and second propeller assemblies are rotated respectively toward the opposite directions, than is presently possible for watercraft and vessels of similar size. See FIG. 16.

DESCRIPTION OF PREFERRED EMBODIMENT

Figure 1:
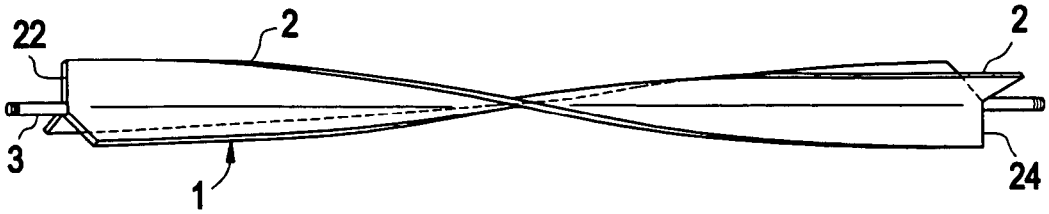
FIG. 1 is a side perspective view of an elongated propeller in accordance with this invention having three helical blades, each having one-half turn from front to rear extending in an a right-hand-turn helical path.

Referring now to the drawings in detail, FIG. 1 shows a propeller 1 made in accordance with this invention, having helical blades 2 which extend in a partially helical path in a right-hand-turn helical direction, affixed to an elongated shaft 3, such as by welding or the like.

Figure 2:
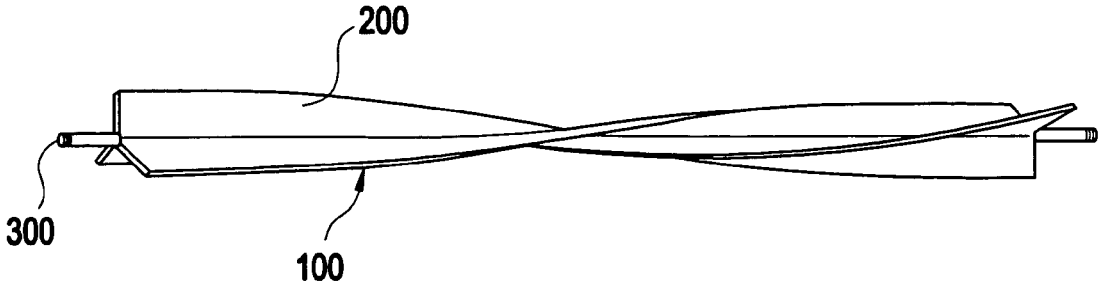
FIG. 2 is a side perspective view of an elongated propeller in accordance with this invention having three helical blades, each having one-half turn from front to rear extending in a left-hand-turn helical path.

FIG. 2 shows a propeller 100 also made in accordance with this invention, having helical blades 200 which extend in a partially helical path in a left-hand turn helical direction, affixed to an elongated shaft 300, such as welding or the like.

The longitudinal axes of propellers 1 and 100 have a length that is preferably about the same as the length of that portion of the boat that is normally in the water when under way. The longitudinal axes of propellers 1 and 100 in accordance with this invention have a length or longitudinal dimension that is greater than the radius of rotation, i.e. greater than the width of the helical blades 2 and 200. In other words, the helical blades 2 and 200 and elongated shafts 3 and 300 are longer than the width of the helical blades 2 and 200 as they extend outwardly from the respective shafts 3 and 300. Two of such propellers 1 and 100, propeller 1 with its blades 2 extending in a right-hand-turn helical path and propeller 100 with its blades 200 extending in the opposite left-hand-turn helical path, are rotatably mounted in a tubular housing 4 having an intake opening 5 and a discharge opening 6. The propellers and housing are shown installed under the hull 7 of a boat 8. Ring bearings 9 are affixed circumferentially around each propeller and secured such as by bolts, rivets or welding to the outer edge of each blade 2 and 200. The ring bearings 9 are spaced apart at appropriate positions throughout the length of each propeller to give the blades 2 and 200 additional rigidity and to prevent bending of the elongated propellers mounted for operation. Bearing races 10 are provided in the housing 4 to cooperatively receive and rotatably hold the ring bearings 9.

A ring gear 11 may be affixed circumferentially around each propeller 1 and 100, each ring gear 11 in mesh with the other so when one propeller 1 is rotated in one direction the other propeller 100 is rotated in the opposite direction. The ring gear 11 of one propeller 1 is in driving engagement with driving gear 12 mounted for rotation connected by shaft 13 to a power source through a transmission mechanism.

For large ships, additional pairs of meshed ring gears 11 are spaced apart along each propeller with one in each pair in mesh with additional powered drive gears 12 rotatably mounted in the ship. Additional driving means may also be provided, wherein the propellers are not geared together, but are operable separately by twin power sources, so one propeller for example may be rotated in one direction and the other in the opposite direction, for example to enable great maneuverability in turning quickly. Such separate driving means have a synchronous electronic control assembly 400 so the propeller blades 2 and 200 of propellers 1 and 100 can be operated in the same relative mirror-image position when moving the boat fore and aft. Electric motors 500 may be mounted on the shaft of each elongated propeller and connected to a power source, such as a diesel powered generator (not shown), through an operating control panel 600 mounted in the boat or ship.

The helical blades 2 and 200 may have more than one spiral turn on their respective shafts 3 and 300 from front to rear, or they may have less than one complete spiral turn as shown in FIGS. 1 and 2. The number of spiral turns, pitch of the blade, its length and width and number of blades, will depend on the type of boat on which the propeller will be used. On a boat thirty feet in length with twenty feet of its length in surface contact with the body of water when under way, having a normal draft of two feet, appropriate dimensions of each propeller for such a boat may be as follows:

3 blades

½ spiral turn of each blade from front to rear 20 feet in length for each blade

10–12 inches radial width for each blade

The blades 2 and 200 may be made of various materials, including materials which are buoyant in water such as rubber and wood. Other materials that may be used in their construction are steel, as well as other metals and alloys, plastic materials including fiberglass, and synthetic as well as natural rubber with appropriate stiffening or reinforcing means. The shaft is preferably of steel, but may also be made of other material. The blades should preferably be made of a strong but lightweight material.

When two of these propellers 1 and 100 are used on a boat, they are mounted to normally rotate in opposed directions to neutralize any lateral torque effect. The helix of one propeller has its spiral turn in one direction and that of the other in the opposite direction when the two propellers are mounted parallel. The propellers are mounted close together, with the bearing races 10 carrying the ring bearings 9 of each adjacent propeller being joined together. The rotation of the propellers is synchronized by appropriate positioning and meshing of ring gears 11 so that the radial position of the corresponding blades 2 and 200 of each respective propeller 1 and 100 is preferably in mirror image relationship, with respect to each other, or differs only as the right hand differs from the left. When separate driving means are used for each propeller, tachometers are used to synchronize the speed of rotation and position of each propeller relative to the other in order that each blade of each propeller is normally in a position of mirror-image to each other for greatest forward, or rearward, thrust effect. However, the propellers need not be mirror-image positioned to be operable in moving a boat through the water, and the operator of separately driven propellers can adjust their speed of rotation, and relative position of the blades of each propeller as may be desired.

Figure 3:
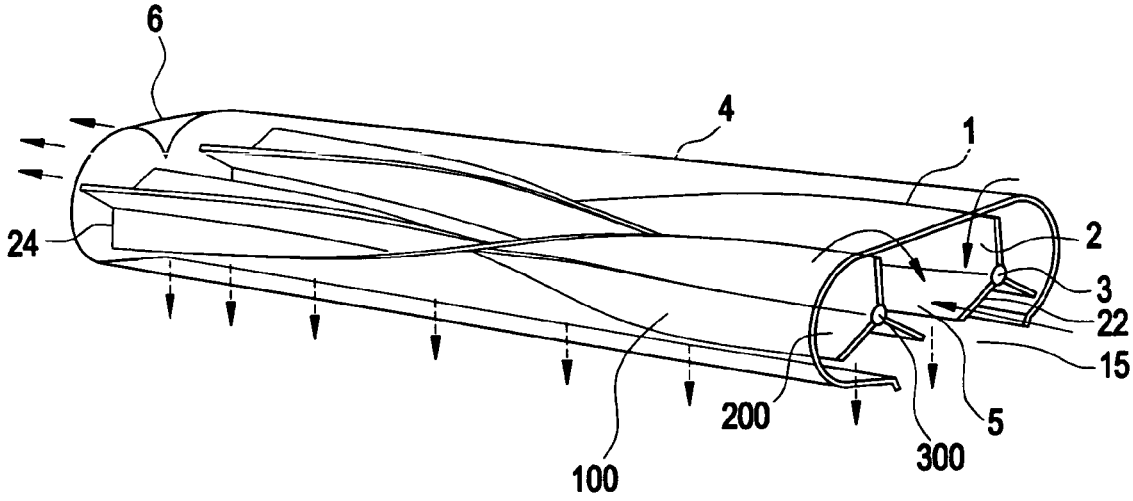
FIG. 3 is a perspective view from one side of a pair of elongated propellers as shown in FIGS. 1 and 2 mounted side-by-side within a housing (shown transparent to see the propellers inside), the housing having an inlet opening, a discharge opening and an elongated longitudinal opening along the bottom, the propeller having the elongated blades that extend in the right-hand-helical path shown to the left and the one having the elongated blades that extend in the left-hand-helical path shown to the right, with arrows indicating the opposite direction of rotation of each of the propellers, and other arrows indicating the downward direction of the water when the propellers are rotated in such opposite directions of rotation.
Figure 4:
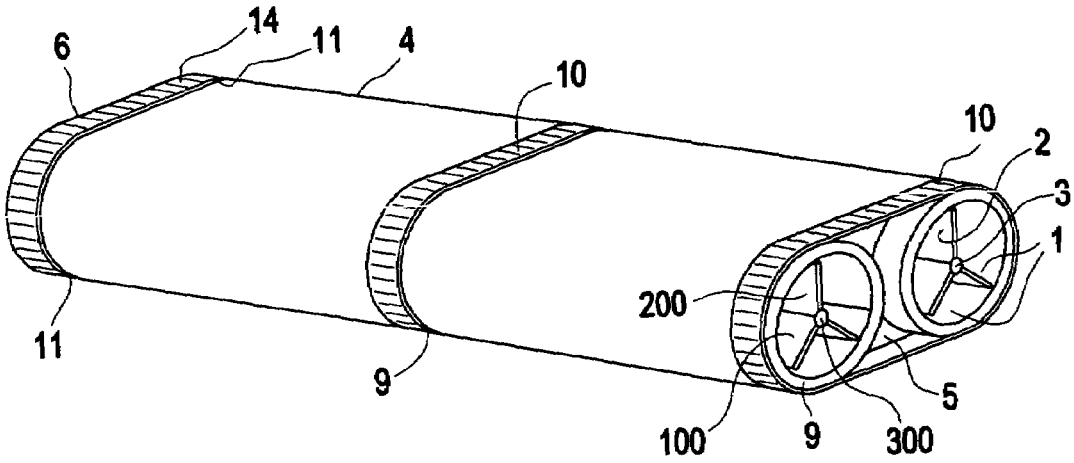
FIG. 4 is a perspective view from one side of a modified propeller assembly in accordance with this invention, showing a pair of elongated propellers in accordance with this invention in side-by-side relationship within a modified housing.
Figure 5:
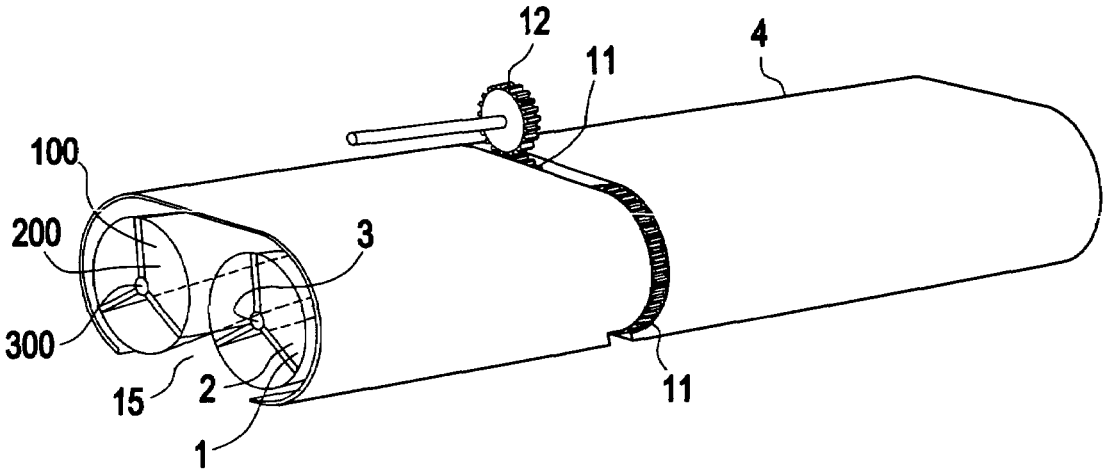
FIG. 5 is a perspective view from one side of another modified propeller assembly in accordance with this invention, showing a pair of elongated propellers in side-by-side relationship, in which the rotational drive shaft and gear are shown in mesh with the driven ring gears secured to and around each propeller, to rotate one of the propellers in a clockwise direction of rotation and the other counterclockwise.
Figure 6:
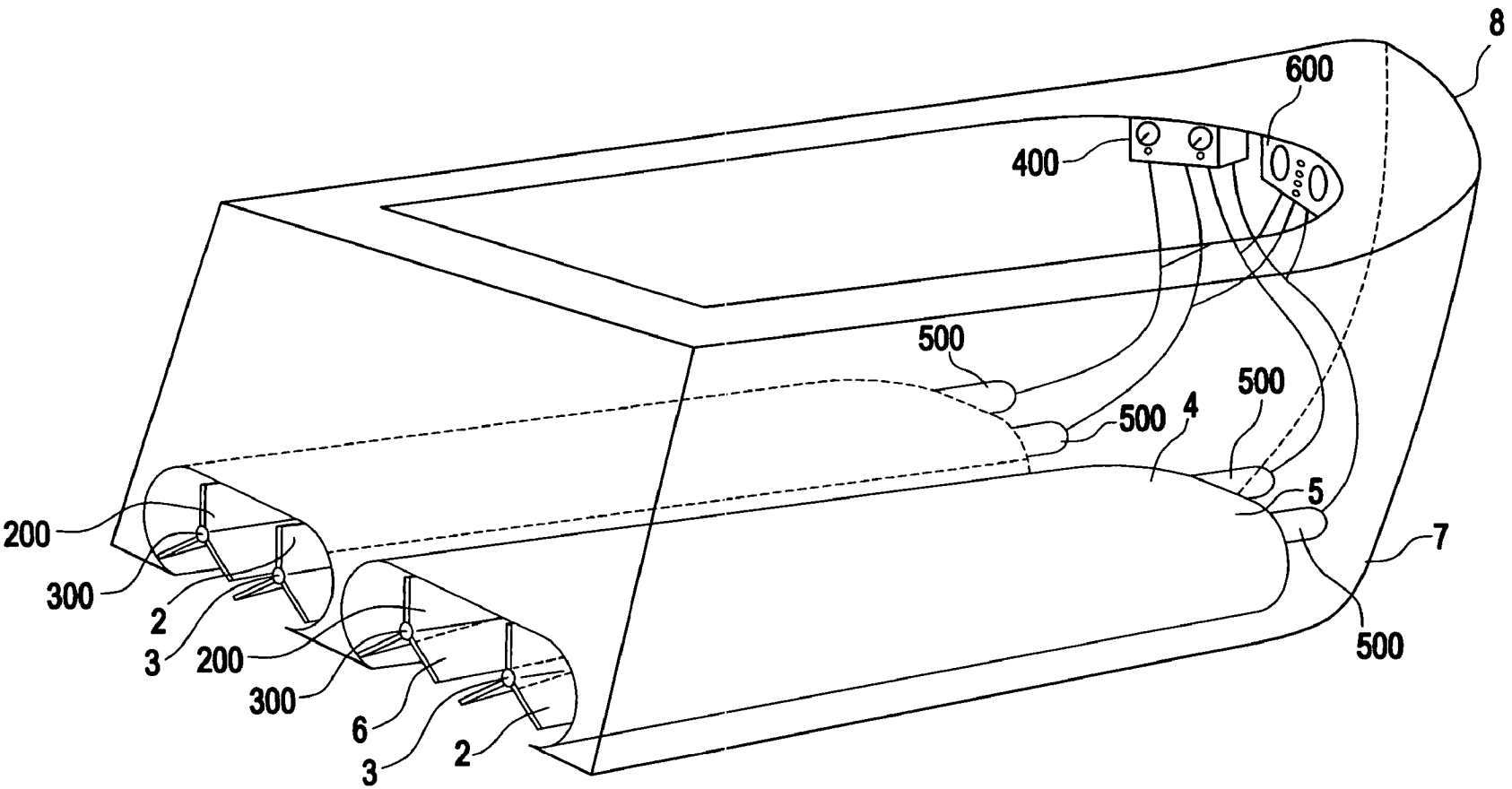
FIG. 6 is a perspective view of the hull portion of a motor yacht, shown partially transparent to illustrate two propeller assemblies in accordance with this invention mounted in the lower portion of the hull, each propeller assembly having a housing with a pair of side-by-side elongated propellers mounted for rotation in opposite directions of rotation therein.

A preferred position of the two propellers and direction of rotation is as follows. Viewing from the front, which is the right hand side of the propeller assembly in FIG. 3, the helical blades 2 of the propeller 1 to the right have their spiral turns to the right following a right-hand-turn helical path, and that propeller 1 is rotated counter clockwise. The helical blades 200 of the propeller 100 on the left in FIG. 3 have their spiral turns to the left following a left-hand-turn helical path, and that propeller 100 is rotated clockwise.

In operation, water enters the intake opening 5 where it is met by the oppositely rotating helical blades 2 and 200 and urged rearward. The pressure of the body of water at the intake opening 5 and discharge opening 6 is equal when the boat is at rest, but as the blades are rotated and water is urged toward the rear the water pressure at the discharge opening 6 tends to increase and to resist the movement of further water toward the region of the discharge opening and stern of the boat. At the same time the pressure of the water at the intake opening 5 in the region of the bow of the boat tends to decrease as water is urged away from the front towards the rear by rotation of the blades 2 and 200. The result is movement of the boat forward in the water and resistance to movement of the water backward.

In boats with conventional screw propellers mounted astern, the pressure differential in front of and in back of the propellers merely acts on the propellers in the stern region of the boat. No decrease of water pressure is created in the region of the bow of the boat, but on the contrary water pressure in that region tends to increase as the hull of the boat is urged forward against the water by the conventional stern mounted screw propellers thus tending to cancel out part of the pressure differential created by the propellers at the location fore and aft of the propellers. In addition, waves tend to form in the region of the bow as a result of the hull being pushed against the body of water expending additional energy. With propellers of the type disclosed in this invention, a decrease of water pressure is created in the region of the bow and intake opening 5 relative to that of the body of water as a whole. The tendency to create a wave by displaced water resulting from movement of the boat forward is off-set in whole or in part by a tendency of the displaced water to move toward the region of decreased water pressure. In the bow region the water is met by the helical blades at the intake opening 5 and channeled in the direction of the discharge opening 6.

The housing 4 may have a longitudinal opening 15 underneath running the entire length from the intake opening to the discharge opening. This longitudinal opening 15 may be adjustable to partial or fully closed positions by cover members 16. The purpose of the longitudinal opening 15 is to allow the propeller blades 2 and 200 to urge part of the water downward through opening 15 as well as rearward through discharge opening 6. This tends to increase water pressure below the boat as well as to the rear, thus tending to urge the boat upwardly and outwardly of the water as well as forwardly when the propellers are rotated. A closure gate 17 may also be provided to close or partially close discharge opening 6, to enable direction of more water downward if desired, for example when first getting under way. Ideally, the only substantial portion of the boat below the water line should be the propeller or propellers when the boat is fully under way, thus decreasing sliding friction of the hull against the water to a minimum. The energy expended by friction of water against the propeller blades is utilized in performing the motion imparting function, so such energy is not wasted and such friction does not impede forward progress of the boat but in fact is an element that assists in moving the boat forward, as the friction between a rope climber's hand and the rope, or between a powered wheel and the ground. The greater the blade surface in rotating frictional contact with the water, the greater the ability to move heavier loads through the water at more rapid speeds.

The propeller system according to this invention also avoids much of the slippage experienced with conventional screw propellers. The housing 4 is closely fitted above the propellers and follows their exterior contour closely around the outer sides and bottom. Water is thus confined within the spaces between the blades 2 and 200 as they are rotated, and even at high speeds of rotation the water cannot fly radially away from the propeller blades but is forced to move rearwardly only, unless the cover members 16 are in an opened position to permit some movement of water downward. Conventional screw propellers if rotated at very rapid speeds tend to throw water radially away from the blade, creating what is known as cavitation.

The propellers 1 and 100 may also be rotatably mounted directly on the side or under the hull of a boat without the tubular housing 4. One such propeller may be used alone as well as in oppositely rotated pairs as described. If desired, more than two such propellers may also be used. On large ships for example two or more pairs of the oppositely rotating propellers 1 and 100 as described may be desirable, each pair mounted in fore and aft longitudinal relationship. They can also be conveniently mounted along the lower sides of ships having a steeply inclined hull and keel with one propeller above another, rather than completely under the hull as with boats having round or flat bottomed hulls.

Figure 8:
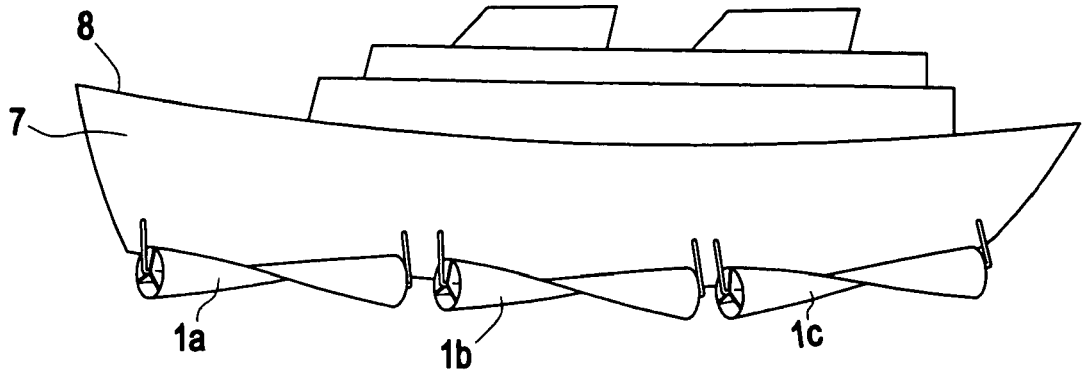
FIG. 8 is a side elevation view of a ship in which three elongated propellers in accordance with this invention can be seen in longitudinal alignment.
Figure 9:
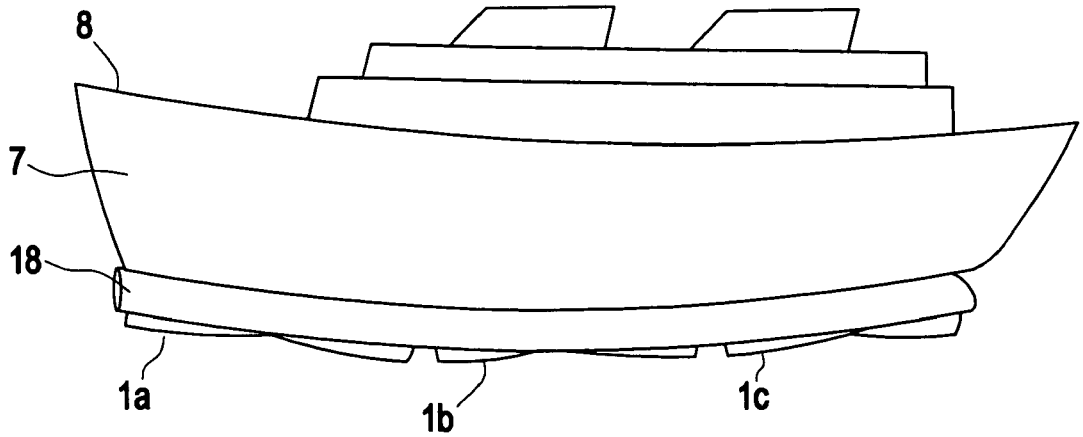
FIG. 9 is a side elevation view of a ship as seen in FIG. 8 but in which the upper portion of the elongated propellers is covered by an elongated housing that extends substantially the length of the ship.
Figure 10:
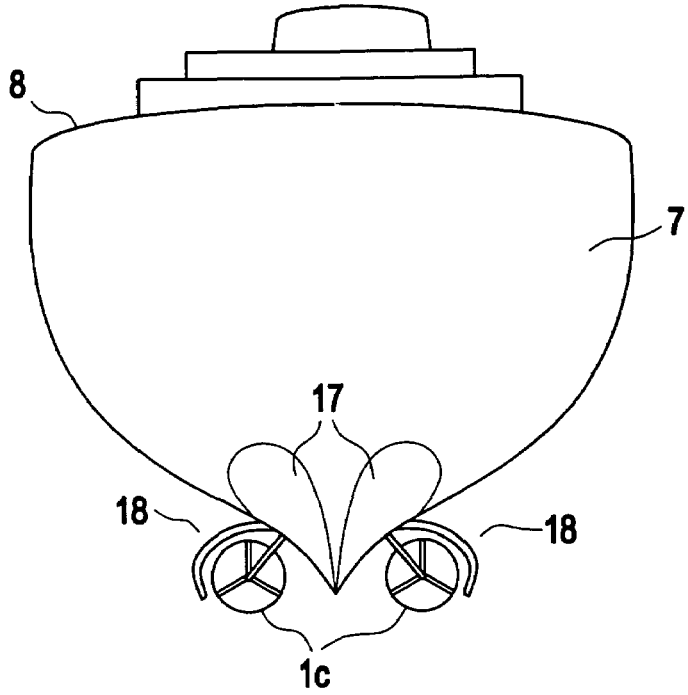
FIG. 10 is an end elevation view from the rear of a ship having a pair of propellers in accordance with this invention mounted thereon, in which a rotatable closure member for the discharge openings at the rear of the propeller housing can be seen in the open position.
Figure 11:
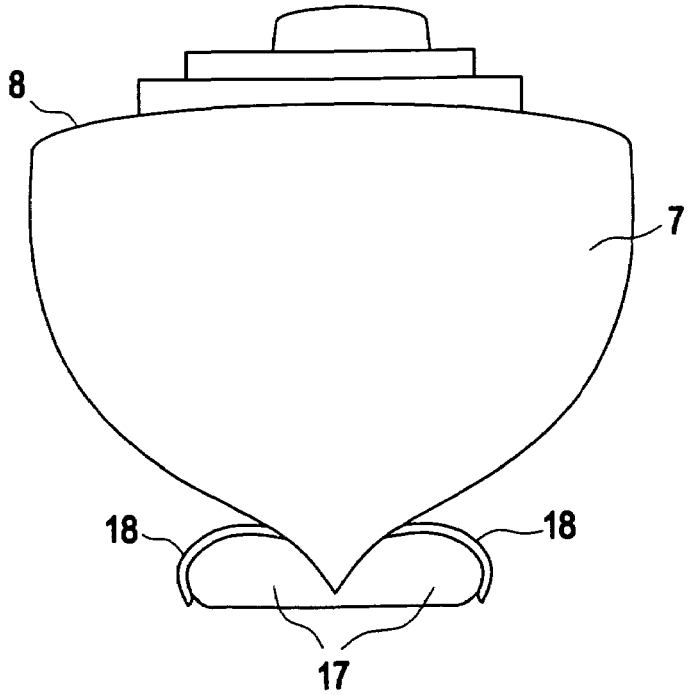
FIG. 11 is an end elevation view from the rear as the ship as seen in FIG. 10, but with the rotatable closure members shown in the closed position.
Figure 12:
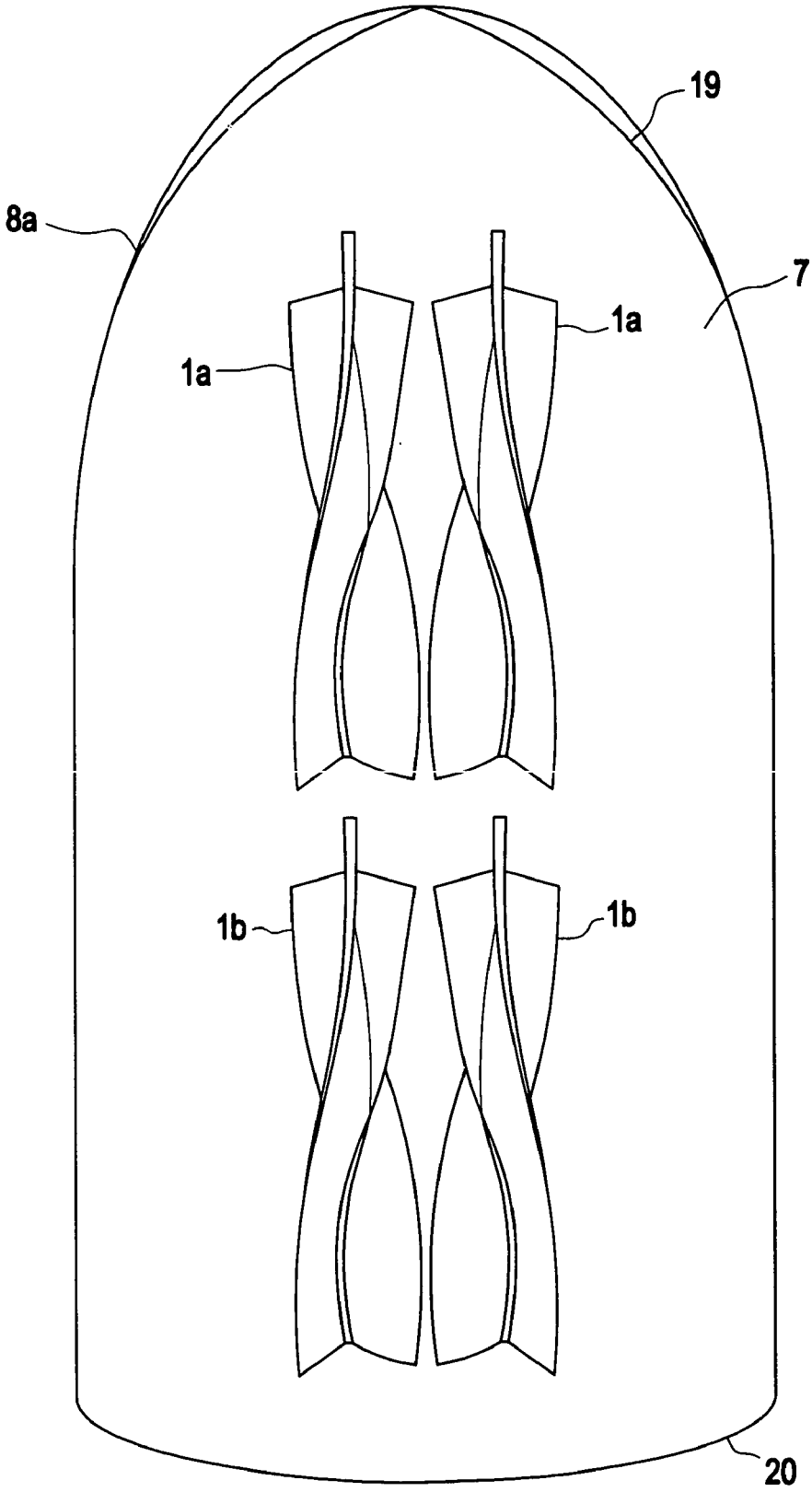

It is within the scope of this invention to provide two or more elongated helical blade propellers 1 and 100 arranged end to end in substantially the same horizontal plane along the hull of a boat from bow to stern. Particularly in large ships, it may not be convenient to use one long propeller that extends from front to rear. It is more convenient to use for example three of such propellers 1 or three pairs of such propellers 1 and 100 when they are mounted along the lower side of a large ship to enable following more closely the contour of the hull of a large ship as shown in FIG. 8. One propeller 1*a* extends from the bow along the hull until the contour begins to curve at the front portion of the middle section of the ship, a second propeller 1*b* in the same horizontal plane extends from near the rear of propeller 1*a* to about the rear portion of the middle section of the ship, and a third propeller 1*c* also in the same horizontal plane extends from near the rear of propeller 1*b* to the stern of the ship. A continuous cover 18 may extend from bow to stern to provide a continuous trough for water to pass successively from propeller 1*a* to 1*b* to 1*c*.

In this section arrangement, the effect is similar to that where the elongated propellers 1 and 100 extend unbroken from bow to stern. The pressure of the water is decreased in the region of the bow when propeller 1*a* is rotated in the direction in which its helical blades exert rearward pressure against the water; the pressure of the water at the rear of propeller 1*a* is increased, but similar rotation of propeller 1*b* creates a corresponding decrease in the pressure of the water in its front region which is near the rear region of propeller 1*a* thus neutralizing the pressure differential in this region passing it along in similar manner to propeller 1*c* which creates an increase in the pressure of the water at the stern. Thus, the net effect is a decrease of water pressure at the bow and an increase of water pressure at the stern, causing movement of the boat forward. Also, the decrease of water pressure in the bow region tends to counteract and avoid the tendency of the displaced water to otherwise form waves.

In addition to this force due to water pressure differential, the helical propeller blades 2 and 200 exert a mechanical force against the water throughout the entire length of the ship urging the ship forward to the extent the water resists movement rearward.

The action of the elongated helical blade propellers 1 and 100 in this invention is similar to the continuous sweep of oars from front to rear of a boat, but without the necessity of removing the blade from the water to return for a new rowing pull as during each reciprocal rowing cycle, and of course a vastly increased speed of the sweep from front to rear is possible by continuously rotating an elongated helical blade. The action of the conventional rear mounted screw propellers is similar to a continuing sweep of oars only at a very tiny longitudinal region astern of the boat. To this extent of thrust from mechanical force of a blade against the water, the elongated propellers of this invention is to the conventional stern mounted screw propellers as a group of oarsmen along the entire length of the boat is to a single oarsman rowing astern with extremely tiny strokes.

As for the thrust due to water pressure differential, the decreased pressure in front of the propeller and increased pressure in back of the propeller is comparable for both types of propellers of equivalent blade width, pitch and speed of rotation. However, the decreased pressure occurs in the region of the bow of the boat with the elongated propellers of this invention which tends to lessen the direct resistance of the body of water against the forward moving hull and tends to lessen wave formation. The pressure differential of conventional stern mounted screw propellers occurs entirely astern of the boat, which effect is partially cancelled by the front portion of the hull of the boat being pushed head-on into the body of water which tends to increase the pressure of the water in the region of the bow. Also, water being pushed in front of the forward moving hull tends to build up into waves thereby dissipating energy, since the actions of stern mounted screw propellers cannot reach the bow region to draw rearward the water being continuously displaced by the forward advancing hull.

The pitch of the blades of elongated propellers can also be much steeper than that of conventional rear mounted screw propellers, which enables the passage of more linear feet of water past the helical blades per each revolution of the propeller. Therefore higher speeds forward per each revolution can be obtained.

Figure 13:
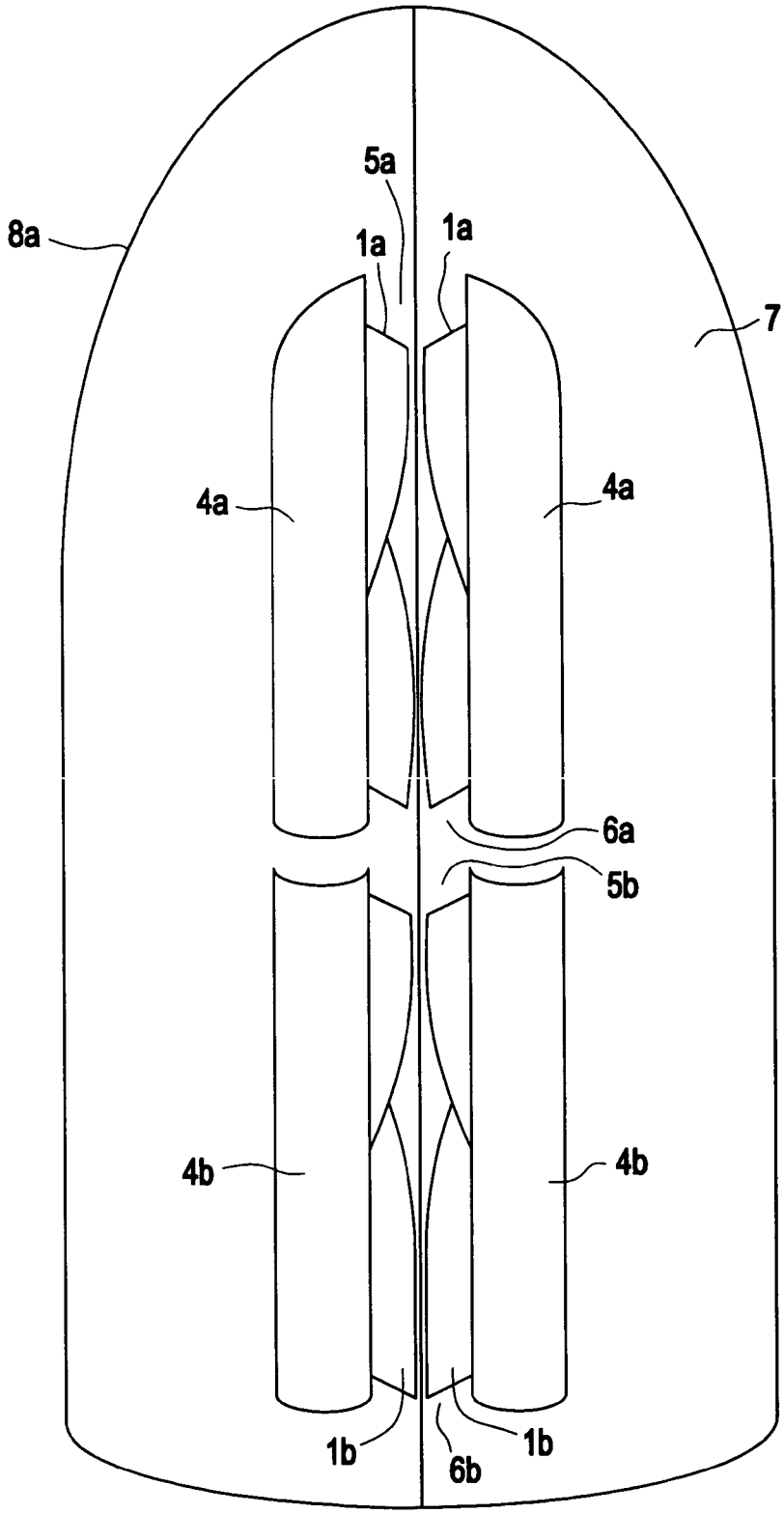
FIG. 13 is an elevation view from the bottom of a ship having two propeller assemblies in accordance with this invention mounted below the hull with propeller housings seen around each of the pairs of propellers, in which the longitudinal openings along the bottom of the propeller housings can be seen in the partially open position.
Figure 16:
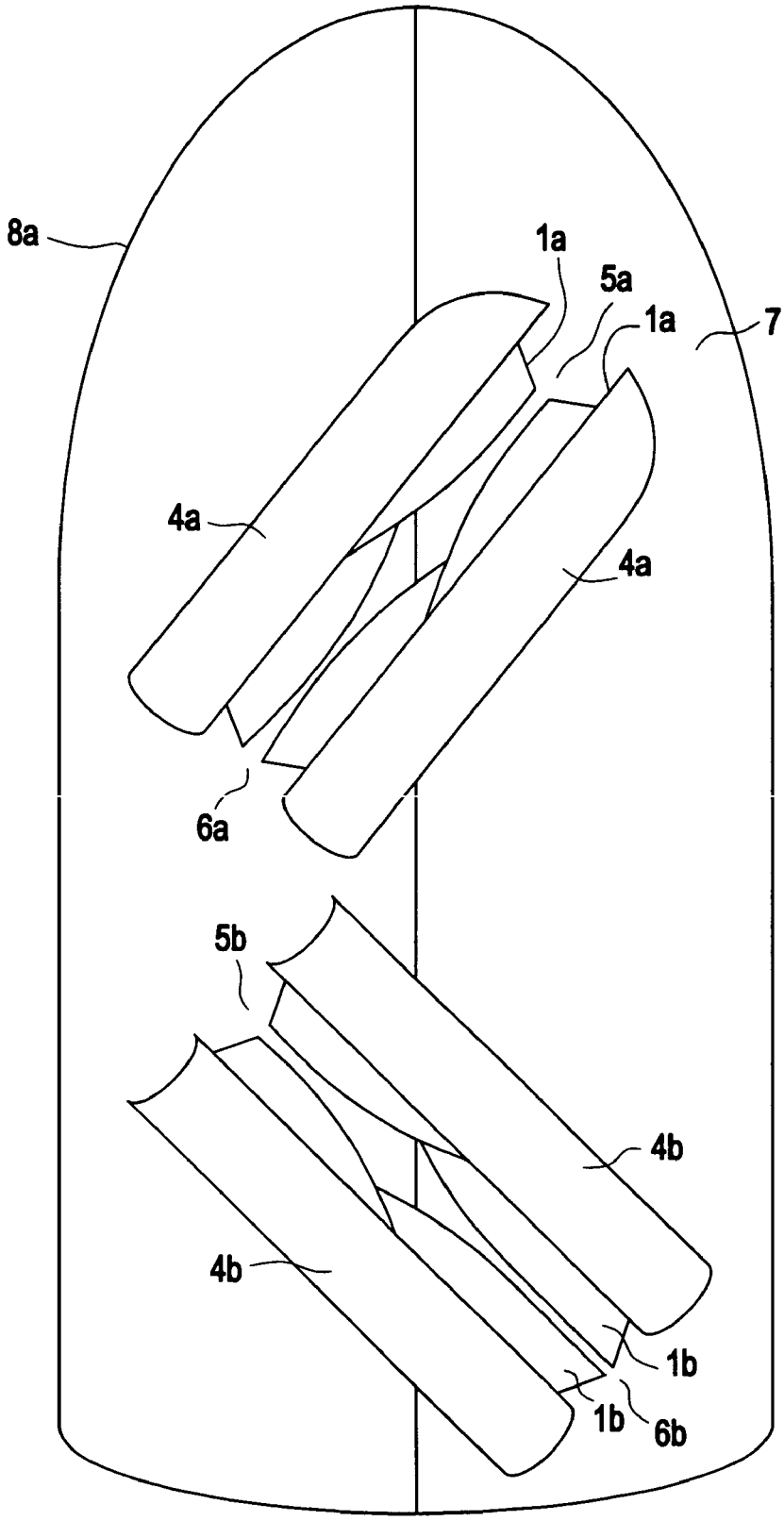
FIG. 16 is an elevation view from the bottom of the ship seen in FIG. 13, but in which the propeller assemblies comprising the housings and propellers therein are pivotally mounted, the forward assembly shown pivoted partially toward the right, the rearward assembly shown pivoted partially toward the left, for more quickly turning the entire ship to the right by such orientation of the operating propeller assemblies than by means of the rudder alone, and for equally quick turning of the entire ship to the left when the forward operating propeller assembly is pivoted toward the left and the rearward operating propeller assembly is pivoted toward the right.
Figure 17:
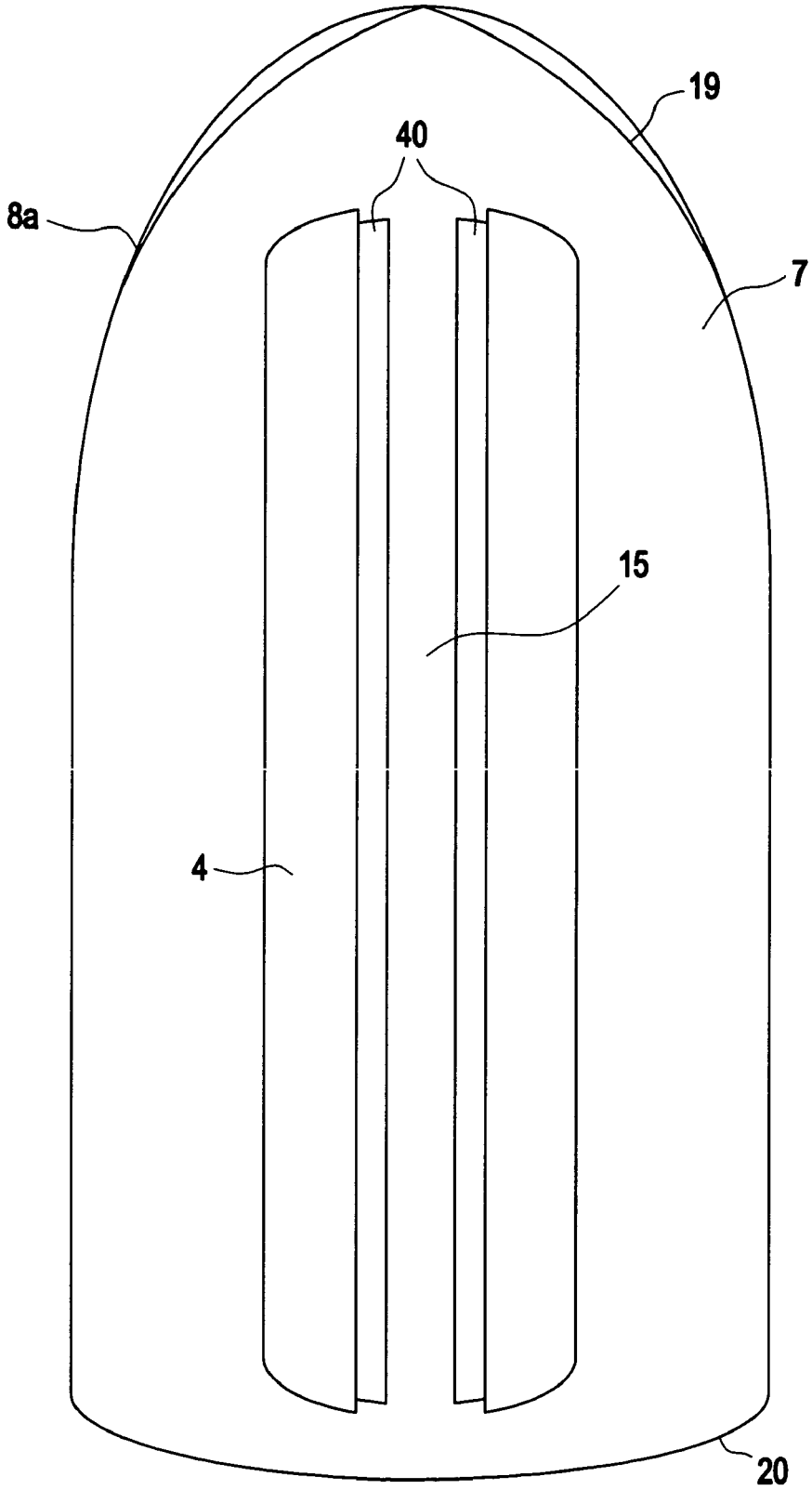
FIG. 17 is a bottom plan view of a ship having a longitudinal housing in accordance with this invention that extends substantially the length of the ship normally in contact with the water in which to house the ship's propulsion mechanism, the housing having an openable downwardly facing wall, illustrating a pair of elongated adjustable closure members projecting partially from each opposite side edge of the bottom portion of the side wall of the housing, such adjustable closure members being movable toward each other to completely close the bottom of the housing and movable away from each other to completely open the bottom or downwardly facing wall for flow of water downwardly therethrough as well as rearwardly when the propulsion mechanism of the ship within said housing is being operated

As shown in FIGS. 13 and 16, it is also within the scope of this invention to have one or more elongated propellers 1*a* near the bow region 19 of the boat 8*a* which would normally be in contact with the water when under way, and one or more of such propellers 1*b* near the stern region 20 with a space between the bow and stern propellers. The elongated propellers 1*a* near the bow region would when rotated for forward movement reduce the pressure differential of water at the intake opening 5*a* of housing 4*a* and increase the pressure differential at discharge opening 6*a*. The elongated propellers 1*b* near the stern would when likewise rotated for forward movement, reduce the pressure differential of water near the intake opening 5*b* of housing 4*b*, thus tending to reach the area of increased water pressure differential created at discharge opening 6*a* and channel it through elongated propellers 1*b* to discharge opening 6*b* creating increased pressure differential at the stern. The net effect would be decreasing pressure differential of the water at the bow of the boat, and transmitting the pressure differential eventually to the rear of the boat, much in the same manner as if the elongated propellers extended in a single unbroken length for the length of the hull of a boat that would be in contact with the water when under way.

The elongated housings 4*a* and 4*b* of this modification having the propellers 1*a* and 1*b* respectively therein may be mounted to pivot to the right and to the left of the longitudinal axis of the hull 7. Elongated housing 4*a* at the bow or forward region of the ship can for example be pivoted to the right as seen in FIG. 16, whereby its rotating propellers 1*a* begin to propel the forward region of the ship forwardly and toward the right. Elongated housing 4*b* at the stern or rearward region of the ship can be pivoted toward the left whereby its rotating propellers 1*b* begin to propel the rearward region of the ship forwardly and toward the left. In this manner, a large ship having the pivotable housings 4*a* and 4*b* with propellers 1*a* and 1*b* in accordance with this invention as described herein, can make an extremely rapid turn to the right or left never before possible. The elongated housings with their elongated propellers therein can then be pivoted back into alignment with the longitudinal axis of the hull to move the ship straight forward in a new direction, or they can be pivoted in respective opposite directions to execute an equally rapid turn in the opposite direction. The elongated housings and elongated propellers in accordance with this invention provide a degree of maneuverability not previously thought possible for large ships based on what has heretofore been known in the prior art.

It is well known that hydroplanes can achieve great speeds since at top speeds substantially the only part of the boat in contact with the water is the propeller. Hydrofoils have also achieved success in increasing speed since the foils tend to raise the hull of the boat out of sliding friction with the water. However, the hydrofoils themselves create sliding friction and perform no function whatever in utilizing their frictional contact with water to impart forward (or rearward) motion to the boat. With respect to hydroplanes, their use is limited to hulls specifically designed to lift from the water upon achieving a given speed, and could not in any case carry great weight or cargoes of great size such as warships, freighters, large passenger liners, large cruise ships, and the like.

It is possible with elongated propellers as described in this invention to enable boats of almost any size or shape to achieve speeds comparable to those of hydroplanes or greater, even ships as large as ocean liners and large ships of war. The main advantage is the increase in efficiency, changing sliding friction into rotating friction much as putting an entire auto in rolling friction with the ground rather than merely having two wheels in the rear in rolling friction and the rest of the car sliding along the ground in sliding friction contact. Another advantage of the elongated spinning fin propellers in accordance with this invention is creating the decreased pressure differential near the bow of the boat to eliminate or reduce the tendency of wave making which otherwise occurs when a body is merely shoved through the water—much as a box shoved along the ground would tend to pile up earth in front. Thus a given amount of energy or power would be able to propel a boat with propellers according to this invention much faster than a boat equipped with conventional screw propellers, or would require less fuel, energy and power to propel the boat at the same speed if it were equipped with conventional screw propellers known to the prior art.

Figure 14:
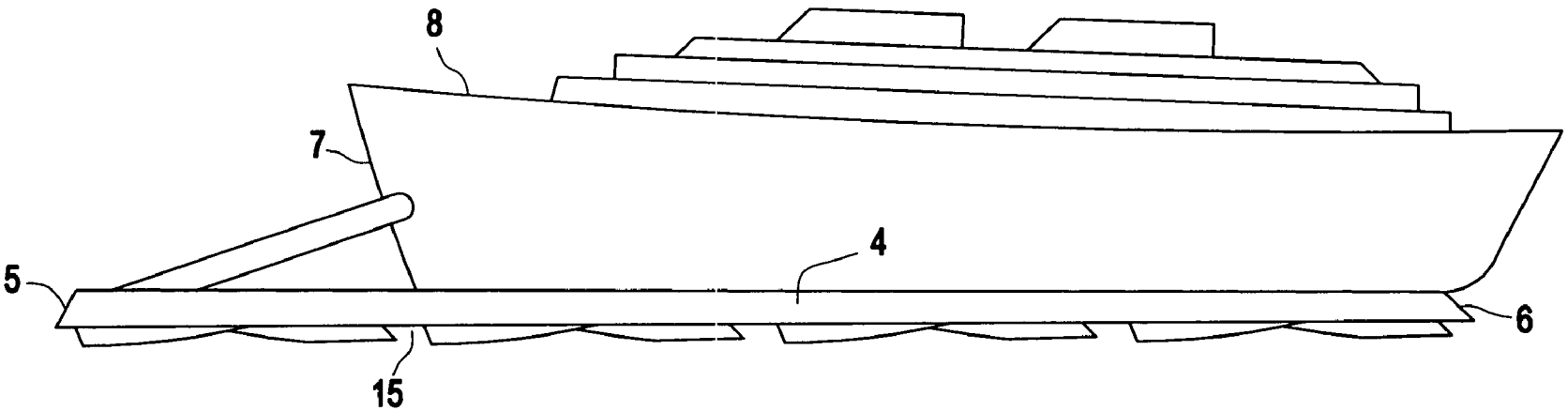
FIG. 14 is a side elevation view of an ocean going ship having a plurality of propeller assemblies longitudinally arranged thereon, including one such propeller assembly positioned forward of the bow of the ship to contact and dissipate waves as the ship approaches thereby lessening wave resistance to forward movement of the ship and smoothing out forward passage of the ship in otherwise heavy seas.
Figure 15:
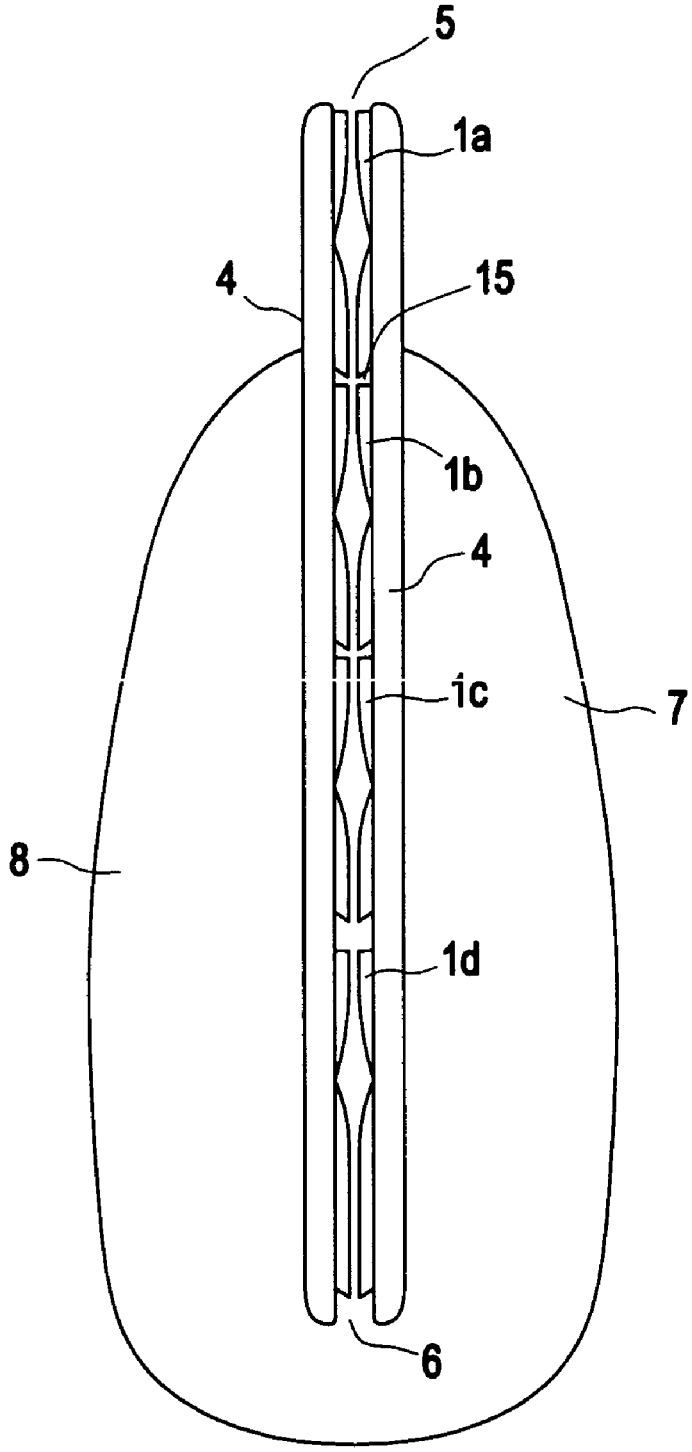
FIG. 15 is an elevation view from the bottom of the ship seen in FIG. 14 and its propeller assemblies mounted along the lower portion of the ship's hull.

In the case of heavy seas, and if desired, the elongated propellers as described herein can be extended beyond the bow of the boat as shown in FIGS. 14 and 15, to meet heavy on-coming waves and largely if not completely dissipate them. The waves ahead would be drawn into intake opening 5. The adjustable longitudinal opening 15 in the bottom of tubular housing 4 could be left open, so the oppositely rotating pairs of elongated propellers 1*a*, 1*b*, 1*c* and 1*d* would force much of the water from such waves downward and in turn tend to lift tubular housing 4 connected with the boat 8 upward, thus tending to smooth out the ride of the boat and enable faster speeds through heavy seas.

By proper adjustment of the rotation speed of the elongated propellers 1*a*, 1*b*, 1*c* and 1*d*, the adjustable longitudinal opening 15 under the housing 4, and the closure gate 17, it is possible to lift substantially the entire hull of the boat out of sliding friction with the water with the only substantial parts remaining in frictional contact being the propellers which when rotated becomes rolling friction capable of imparting movement to the vessel.

When the helical blades 2 and 200 make only a one-half turn from their respective front edge 22 to the rear edge 24, the front edge 22 of the helical blade 2 extends outwardly from the elongated shaft 3 in one direction and the rear edge 24 extends outwardly therefrom in the opposite direction. If the helical blades 2 and 200 make one complete helical turn from the front edge 22 to the rear edge 24, both the front edge 22 and rear edge 24 extend outwardly from the elongated shaft 3 in the same direction. It is within the scope of this invention for the helical blades 2 and 200 to make one or more complete turns or any partial helical turn less than one complete helical turn. When the helical blades 2 and 200 make less than one complete helical turn, the front edge 22 of the helical blade 2 extends outwardly from the elongated shaft 3 in one direction and the rear edge 24 of the helical blade 2 may extend outwardly from the elongated shaft 3 in any other different direction depending on the degrees of the helical turn. A preferred helical blade 2 and 200, each make one-half of a helical turn as it extends from its front edge 22 to its rear edge 24, in which case the front edge 22 extends outwardly from the elongated shaft 3 in one direction and the rear edge 24 extends outwardly from the elongated shaft 3 in the opposite direction.

The elongated propellers as described hereinabove may be mounted for rotation along both sides of the portion of a hull that is in the water when the boat or ship is under way, one or more along the port side thereof in contact with the water and one or more along the opposite starboard side of the hull in contact with the water.

Longitudinal bars or skids 25 may be mounted below the propellers to hold the propellers above the bottom of the body of water in the event the vessel itself becomes grounded. The skids 25 are in parallel closely spaced apart relationship and extend longitudinally for substantially the length of the ship. This feature of the invention makes it possible to still rotate the propellers and provide upward as well as rearward thrust to the ship even though the vessel has become grounded, to thereby lift and free a grounded vessel from its grounded position and enable it to again get underway. Such bars also protect the propellers from contact with other objects such as submerged tree stumps, submerged rocks, and the like. The bars also tend to protect living creatures in the water from contact with the propellers and from injuries they might otherwise sustain. Similar protective bars may also be provided in front and at the rear to prevent contact with the propellers at the front and at the rear and possible damage or injury resulting from such contact.

Jet propulsion motors, hydraulic motors, and other known water propelling mechanisms may also be used to forcibly flow water downwardly through the longitudinal opening 15 of the tubular propulsion housing 4 below the vessel's hull and past the spaced apart bars or skids 25 to lift and free the vessel from its grounded position. Such known water propulsion mechanisms are within the scope of this invention insofar as the spaced apart support members 25 are concerned that enable a grounded vessel to lift and free itself from such condition, and insofar as the elongated housings 4 are concerned that direct and confine the propelled water, without regard to how it is propelled, in a defined channel from front to rear thus increasing efficiency of the propulsion mechanism. In other words, the elongated housings 4 prevent the propelled water from moving toward either side where the forward propulsion force of the propelled water is dissipated and diverted into side thrust on each opposite side of the propeller.

The elongated propellers in accordance with this invention having helical blades that extend from front to rear of that portion of a boat in the water when under way can have a pitch much sharper than prior art water propellers. For example, the blades of a propeller that is one hundred feet long for a boat having such length in the water when under way, following a helical path of one-half turn from front to rear, has a pitch of one-and-eight-tenths degrees. That is, from the front of a hundred foot helical blade in which the front edge of the blade extends upright to the rear edge of the blade which in a one-half helical turn extends downward, the degree change from the upright front edge to the downward rear edge is one hundred and eighty degrees, or one-and-eight-tenths degrees per linear foot.

Figure 7:
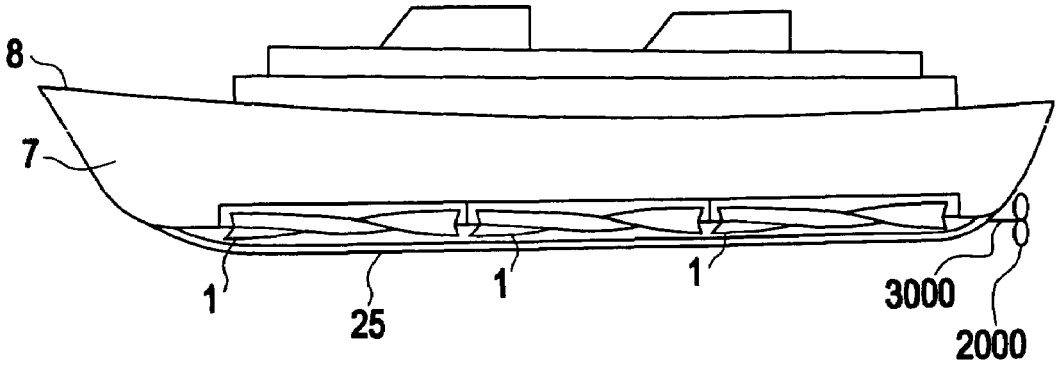
FIG. 7 is an elevation view of a ship having three pairs of elongated propellers in accordance with this invention in longitudinal alignment, and illustrating one of a plurality of longitudinal bar members in close side-by-side relationship extending substantially the length of the ship below the propellers to support them above the ground on the bottom of the body of water in the event the lower portion of the ship makes contact therewith. A conventional longitudinally short screw propeller is also shown at the lower rear of the hull to provide additional or auxiliary thrust for longitudinal movement of the hull forwardly when it and the other propellers are rotated in one direction of rotation and rearwardly when they are rotated in the opposite direction of rotation.

It is within the scope of this invention to use the elongated helical blade propellers and propeller assemblies 1 and 100 in accordance with this invention as shown and described herein, with conventional stern mounted propellers 2000 known to the prior art which have a substantially flatter pitch, as shown in FIG. 7 mounted on drive shaft 3000. The flatter the pitch of a propeller, the greater its initial longitudinal thrust for power but the slower its transfer rate resulting in slower speed through the water. The sharper the pitch of the propeller, the faster its transfer rate but the lower its initial longitudinal thrust. It is an advantage for some watercraft to have both the relatively sharper pitch elongated propellers in accordance with the present invention extending along substantially the entire portion of the watercraft in the water when under way, and the flatter pitch longitudinally short propellers 2000 known to the prior art mounted at the stern. Such combination propeller watercraft in accordance with this invention have the advantages of both greater initial thrust for initial power and faster transfer rate past the propeller blades for increased speed.

Conventional longitudinally short screw propellers 2000 may also be mounted for rotation in spaced apart relationship along a longitudinal shaft mounted along the lower portion of the hull extending from the rear portion of the boat or ship to the forward portion. Such propeller construction will also result in more effective propulsion of the boat or ship forward, and rearward if rotated in the opposite direction of rotation, somewhat comparable to the advantages obtained by using the elongated helical turn propellers 1 in accordance with this invention. The advantages and improvement in performance results in both cases by providing direct propulsion force against the water along the entire submerged portion of the hull, rather than merely at the stern.

What is claimed is:

1. A propeller mechanism comprising a first propeller having a first elongated shaft having a forward end and an opposite rearward end, a first elongated helical blade affixed to said first elongated shaft, said first elongated helical blade having a first end closest to said forward end of said first elongated shaft and an opposite second end closest to said rearward end of said first elongated shaft, said first elongated helical blade extending radially outwardly from said first elongated shaft to terminate outwardly in a first elongated outer blade edge, said first outer blade edge of said first elongated helical blade curving in a first direction of rotation around said first elongated shaft as said first elongated helical blade extends rearwardly from said first end thereof toward said second end thereof to curve in such direction of rotation less than one full rotation around said first elongated shaft to thereupon terminate at said opposite second end of said first elongated blade, a second propeller in side-by side relationship to said first propeller, said second propeller having a second elongated shaft having a forward end and an opposite rearward end, a second elongated helical blade affixed to said second elongated shaft, said second elongated helical blade having a first end closest to said forward end of said second elongated shaft and an opposite second end closest to said rearward end of said second elongated shaft, said second elongated helical blade extending radially outwardly from said second elongated shaft to terminate outwardly in a second elongated outer blade edge, said outer blade edge of said second elongated helical blade curving in a second direction of rotation around said second elongated shaft as said second elongated helical blade extends rearwardly from said first end thereof toward said second end thereof to curve in such direction of rotation less than one full rotation around said second elongated shaft to thereupon terminate at said opposite second end of said second elongated helical blade, said second direction of rotation of said second elongated outer blade edge of said second elongated helical blade around said second elongated shaft being opposite from said first direction rotation of said first elongated outer blade edge of said first elongated helical blade around said first elongated shaft.

2. A propeller mechanism as set forth in claim 1, wherein said first and second elongated helical blades extend rearwardly from their respective first ends to their respective second ends a greater distance than said first and second elongated helical blades extend radially outwardly from their respective first and second elongated shafts to their respective first and second outer blade edges.

3. A propeller mechanism as set forth in claim 2 combination with a boat having a hull, a first longitudinal portion of said hull being in contact with the water in a body of water when under way therein, said propeller mechanism being mounted for rotation on said boat adjacent said first longitudinal portion of said hull in contact with the said water in said body of water when under way therein, said boat including rotation means for rotation of said propellers of said propeller mechanism in opposite directions of rotation whereby each succeeding rearward portion of said first outer blade edge of said first elongated helical blade said first propeller continually faces a corresponding portion of said second outer blade edge of said second elongated helical blade said second propeller as each propeller is rotated in said opposite directions of rotation.

4. A propeller mechanism and boat including a second propeller mechanism as set forth claim 3, said first longitudinal portion of said hull in contact with said water when under way having a port side and an opposite starboard side, said first mentioned propeller mechanism being mounted for rotation on said port side, said second propeller mechanism being mounted on said starboard side.

5. A propeller mechanism and boat including a second propeller mechanism as set forth in claim 3, said second propeller mechanism being mounted for rotation on said boat along said first longitudinal portion of said hull in contact with said water and in front of said first mentioned propeller mechanism.

6. A propeller mechanism as set forth in claim 2, including an elongated tubular housing having a tubular cavity to receive said propeller mechanism therein, said propeller mechanism being received therein and mounted for rotation therein, said tubular housing having a water inlet opening front, a water discharge opening in back, said peripheral side wall closely adjacent each opposite side and the top of said propeller mechanism, said tubular housing having a longitudinal opening along bottom of said propeller mechanism for discharge of water therethrough when said propellers are rotated to draw water into said tubular housing through said longitudinal opening along the bottom and outwardly of said tubular housing through said water discharge opening at the back of said tubular housing.

7. A propeller mechanism as set forth claim 6, including a door in said tubular housing positioned to open, partially close and fully close said longitudinal opening along the bottom thereof.

8. A propeller mechanism as set forth in claim 2 in combination with a boat, said propeller mechanism being mounted for rotation forward of the bow of said boat and for operational contact with the water of a body of water in which said boat is under way to dissipate wave action in the area forward of the bow of said boat, including a support mechanism to support said propeller mechanism in said position forward of said bow of said boat, and a rotational drive mechanism to rotate said propellers in said propeller mechanism when so positioned.

9. A propeller mechanism as set forth in claim 1, wherein said first and second propellers are mounted for rotation in side-by-side relationship and in opposite directions of rotation whereby each succeeding rearward portion of said first outer blade edge of said first elongated helical blade of said first propeller continually faces a corresponding portion of said second outer blade edge of said second elongated helical blade said second propeller as each propeller rotated in said opposite directions of rotation.

10. A propeller mechanism as set forth claim 9, including drive means for rotating said first and second propellers in said opposite directions of rotation.

11. A propeller mechanism and water vessel as set forth in claim 1, including an elongated housing to receive said propeller mechanism, said housing having a bottom wall, a longitudinal opening along said bottom wall for propulsion of water downwardly through said longitudinal opening when said propellers are rotated, and spaced apart support means mounted below said longitudinal opening for preventing contact of said propellers with an object therebelow.

12. A propeller mechanism and water vessel as set forth claim 11, wherein said spaced apart support means includes a first longitudinally extending support member and a second longitudinally extending support member spaced apart laterally from said first longitudinally extending support member for propulsion of water downwardly therebetween.

13. A propeller mechanism and water vessel as set forth in claim 1, including an elongated housing to receive said propeller mechanism, said housing having a front wall, an intake opening in said front wall for propulsion of water inwardly through said intake opening when said propellers are rotated, and spaced apart contact prevention means mounted in front of said intake opening for preventing contact of said propellers with an object at said intake opening in said front wall.

14. A propeller mechanism and water vessel as set forth claim 1, including an elongated housing to receive said propeller mechanism, said housing having a rear wall, a discharge opening in said rear wall for propulsion of water outwardly through said discharge opening when said propellers are rotated, and spaced apart contact prevention means mounted over said discharge opening for preventing contact of said propellers with an object at said discharge opening in said rear wall.

15. A propeller mechanism having a first propeller having a first longitudinal axis, a first elongated helical blade extending along said first longitudinal axis, said first elongated helical blade having a first end and an opposite second end, said first elongated helical blade extending radially outwardly from said first longitudinal axis to terminate outwardly in a first elongated outer blade edge, said first outer blade edge of said first elongated helical blade curving in a helical path in first direction of rotation around said first longitudinal axis as said first elongated helical blade extends rearwardly from said first end thereof toward said second end thereof to curve in such direction rotation less than one full rotation around said first longitudinal axis to thereupon terminate at said opposite second end of said first elongated helical blade, a second propeller side-by-side relationship to said first propeller, said second propeller having a second longitudinal axis, a second elongated helical blade extending along said second longitudinal axis, said second elongated helical blade having a first end and an opposite second end, said second elongated helical blade extending radially outwardly from said second longitudinal axis to terminate outwardly in a second elongated outer blade edge, said outer blade edge of said second elongated helical blade curving in a helical path a second direction of rotation around said second longitudinal axis as said second elongated helical blade extends rearwardly from said first end thereof toward said second end thereof to curve in such direction of rotation less than one full rotation around said second longitudinal axis to thereupon terminate at said opposite second end of said second elongated helical blade, said second direction of rotation of said second elongated outer blade edge of said second elongated helical blade around said second longitudinal axis being opposite from said first direction of rotation of said first elongated outer blade edge of said first elongated helical blade around said first longitudinal axis.

16. A propeller mechanism as set forth in claim 15 wherein said first and second elongated helical blades extend rearwardly from their respective first ends to their respective second ends a greater distance than said first and second elongated helical blades extend radially outwardly from their respective first and second longitudinal axes to their respective first and second outer blade edges.

17. A propeller mechanism as set forth in claim 15, wherein said first and second propellers are mounted for rotation in side-by-side relationship and in opposite directions of rotation whereby each succeeding rearward portion of said first outer blade edge of said first elongated helical blade of said first propeller continually faces a corresponding portion of said second outer blade edge of said second elongated helical blade of said second propeller as each propeller is rotated in said opposite directions of rotation.

18. A propeller mechanism as set forth in claim 15, in combination with a boat having a hull, a first longitudinal portion of said hull being in contact with the water in a body of water when under way therein, said propeller mechanism being mounted for rotation on said boat adjacent said first longitudinal portion of said hull in contact with the said water in said body of water when under way therein, said boat including rotation means for rotation of said propellers of said propeller mechanism in opposite directions of rotation whereby each succeeding portion of said first outer blade edge of said first elongated helical blade of said first propeller continually faces a corresponding portion of said second outer blade edge of said second helical blade of said second propeller.

19. An elongated helical blade propeller in combination with a boat having a hull, a housing extending longitudinally along the bottom of said hull, said elongated blade propeller being mounted for rotation in said housing, said housing having a bottom wall facing downwardly, a longitudinal opening in said bottom wall of said housing for flow of water downwardly there through when said propeller is rotated, and spaced apart support members secured below said longitudinal opening to protect said propeller from contact by an object that might otherwise interfere with rotation of said propeller.

20. An elongated helical blade propeller in combination with a boat having a hull as set forth in claim 19, wherein said housing includes a forward end, an intake opening at said forward end, spaced apart protective members secured over said intake opening to protect said propeller in said housing from contact by an object that might otherwise interfere with rotation of said propeller.

21. An elongated helical blade propeller in combination with a boat having a hull as set forth in claim 19, wherein said housing includes a rearward end, a discharge opening at said rearward end, spaced apart protective members secured over said discharge opening to protect said propeller in said housing from contact by an object that might otherwise interfere with rotation of said propeller.

22. A propeller mechanism to lift and free a water vehicle from a grounded position on the bottom of a body of water, including an elongated housing having a through passageway positioned longitudinally along the bottom of said water vehicle, said housing having a downwardly facing bottom wall, a longitudinal opening along said downwardly facing bottom wall, a water propelling mechanism in said elongated housing to flow water into said housing and downwardly through said longitudinal opening when said water propelling mechanism is operated, including spaced apart support members mounted below said housing and said longitudinal opening to support said water propelling mechanism above and out of contact with the ground and other objects that could otherwise interfere with operation of said water propelling mechanism.

23. A propulsion assembly and a water vessel having a longitudinal axis, a forward portion and a rearward portion, said propulsion assembly comprising a first forward propulsion mechanism having longitudinal axis mounted below said forward portion of said water vessel, said first forward propulsion mechanism being pivotable between a position wherein the said longitudinal axis of said first forward propulsion mechanism extends in the same direction as said longitudinal axis of said water vessel and a position wherein said longitudinal axis of said first forward propulsion mechanism extends at an obtuse angle toward one side of said longitudinal axis said water vessel, a second forward propulsion mechanism having a longitudinal axis mounted below said rearward portion of said water vessel, said second forward propulsion mechanism being pivotable between a position wherein the said longitudinal axis of said second forward propulsion mechanism extends in the same direction as said longitudinal axis of said water vessel and a position wherein said longitudinal axis of said second forward propulsion mechanism extends at an obtuse angle toward the opposite side of said longitudinal axis of said water vessel, to more rapidly turn said water vessel from one forward direction to another when said first and second forward propulsion mechanisms are positioned at said respective obtuse angles to said longitudinal axis of said water vessel.

* * * * *